US006283881B1

(12) United States Patent
Feeney

(10) Patent No.: US 6,283,881 B1
(45) Date of Patent: Sep. 4, 2001

(54) GAME BALL

(75) Inventor: Brian Feeney, Enfield, CT (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 0 days.

(21) Appl. No.: 09/455,833

(22) Filed: Dec. 6, 1999

Related U.S. Application Data

(63) Continuation-in-part of application No. 09/019,999, filed on Feb. 6, 1998, now abandoned.

(51) Int. Cl.[7] ..... A63B 41/08
(52) U.S. Cl. ..... 473/596
(58) Field of Search ..... 473/596, 597, 473/598, 599, 603–605, 607–609; 40/327; D21/707, 713

(56) References Cited

U.S. PATENT DOCUMENTS

| | | | | |
|---|---|---|---|---|
| D. 45,741 | * | 5/1914 | De Mattia | D21/713 |
| D. 359,093 | | 6/1995 | Shishido et al. . | |
| D. 408,876 | * | 4/1999 | Feeney | D21/713 |
| 2,495,079 | * | 1/1950 | Sonnett et al. | 473/597 |
| 3,091,562 | | 5/1963 | Berlepsch . | |
| 3,863,923 | * | 2/1975 | Anderson | 40/327 |
| 4,318,544 | * | 3/1982 | Brine, Jr. | 473/596 |
| 5,165,685 | | 11/1992 | Hynes . | |
| 5,320,345 | | 6/1994 | Lai et al. . | |
| 5,419,552 | | 5/1995 | Meyer . | |
| 5,427,372 | | 6/1995 | Ratner et al. . | |
| 5,497,699 | | 3/1996 | Mather . | |
| 5,518,234 | | 5/1996 | Palmquist . | |
| 5,681,233 | | 10/1997 | Guenther . | |

* cited by examiner

*Primary Examiner*—Steven Wong

(57) ABSTRACT

A game ball with increased gripability including a bladder fabricated of an air impervious elastomeric material and a carcass overlying the bladder. The carcass has a common thickness over the majority of its extent and an exterior surface formed with a plurality of raised projections. The raised projections have a height of between about 0.030 inch and 0.120 inch, preferably about 0.120 inch. The projections are in the form of loops with supplemental projections there within.

10 Claims, 4 Drawing Sheets

GAME BALL

RELATED APPLICATION

This application is a Continuation-in-Part of application Ser. No. 09/019,999 filed Feb. 6, 1998 now abandoned.

BACKGROUND OF THE INVENTION

1. Field of the Invention

The present invention relates to a game ball and more, particularly pertains to providing distinctive surface configurations in the form of raised projections for increased gripability.

2. Description of the Prior Art

The use of balls with surface configurations of various designs and configurations is known in the prior art. More specifically, balls with surface configurations of various designs and configurations heretofore devised and utilized for the purpose of marking balls and for rendering such surfaces more grippable through various methods and apparatuses are known to consist basically of familiar, expected, and obvious structural configurations, notwithstanding the myriad of designs encompassed by the crowded prior art which has been developed for the fulfillment of countless objectives and requirements.

By way of example, note U.S. Pat. No. 3,091,562 to J. C. Berlepsch, Jr., et al.; U.S. Pat. No. 5,165,685 to Hynes; 5,320,345 to Lai et al.; U.S. Pat. No. 5,419,552 to Meyer; U.S. Pat. No. 5,427,372 to Ratner et al.; U.S. Pat. No. 5,497,699 to Mather; U.S. Pat. No. 5,518,234 to Palmquist; U.S. Pat. No. 5,681,233 to Guenther et al.; and U.S. Pat. No. Des. 359,093 to Shishido et al.

While these devices fulfill their respective, particular objectives and requirements, the aforementioned patents do not describe a basketball that allows providing distinctive surface configurations in the form of raised loops and/or supplemental projections on the surface of a basketball and other game balls.

In this respect, the basketball according to the present invention substantially departs from the conventional concepts and designs of the prior art, and in doing so provides an apparatus primarily developed for the purpose of providing distinctive surface configurations in the form of raised loops and/or supplemental projections on the surface of basketballs for increased gripability.

It can, therefore, be appreciated that there exists a continuing need for a new and improved basketball which can be used for providing distinctive surface configurations for improved grippability in the form of projections including loops and other projections to the surface of basketballs. In this regard, the present invention substantially fulfills this need.

SUMMARY OF THE INVENTION

In view of the foregoing disadvantages inherent in the known types of balls with surface configurations of various designs and configurations now present in the prior art, the present invention provides an improved basketball. As such, the general purpose of the present invention, which will be described subsequently in greater detail, is to provide a new and improved basketball and method which has all the advantages of the prior art and none of the disadvantages.

To attain this, the present invention essentially comprises a new and improved basketball having improved gripability. First provided is a bladder fabricated of an air impervious elastomeric material. The bladder is formed in a spherical configuration with spiral strands there around. A carcass is next provided. The carcass is formed in a spherical configuration. The carcass overlies the strands. A series of ribs extend outwardly from the carcass. The ribs have a thickness of between about 0.2 and 2.0 millimeters, preferably about 1.0 millimeters. A plurality of panels are provided over the majority of the extent of the carcass. The panels are coupled to the exterior surface of the carcass between the ribs. The panels have a thickness of between about 0.2 and 2.0 millimeters, preferably about 1.0 millimeters. The panels have an exterior surface formed with a plurality of raised projections. The raised projections have a height of between about 0.030 inch and 0.120 inch, preferably about 0.060 inch. The projections are in the form of loops with supplemental projections there within. The projections have a surface area which covers between about 20 percent and 70 percent of the surface area of the ball. The areas between the projections are between about 0.15 inch and 0.50 inch. The projections include primary loops with supplemental, generally linear projections within the primary loops.

In a different embodiment the projections consist of a series of bone shaped objects. These projections have individual surfaces areas between about 0.150 and 0.500 square inch, are raised about 0.100 inch above the general surface of the ball and cover about 60 percent of the ball surface.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved basketball which has all of the advantages of the prior art balls with surface configurations of various designs and configurations and none of the disadvantages.

It is another object of the present invention to provide a new and improved basketball which may be easily and efficiently manufactured and marketed.

It is further object of the present invention to provide a new and improved basketball which is of durable and reliable constructions.

An even further object of the present invention is to provide a new and improved basketball which is susceptible of a low cost of manufacture with regard to both materials and labor, and which accordingly is then susceptible of low prices of sale to the consuming public, thereby making such basketball economically available to the buying public.

Even still another object of the present invention is to provide a game ball with increased gripability including a bladder fabricated of an air impervious elastomeric material and a carcass overlying the bladder. The carcass has a common thickness over the majority of its extent and an exterior surface formed with a plurality of raised projections. The raised projections have a height of between about 0.030 inch and 0.120 inch, preferably about 0.060 inch. The projections are in the form of loops with supplemental projections there within.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
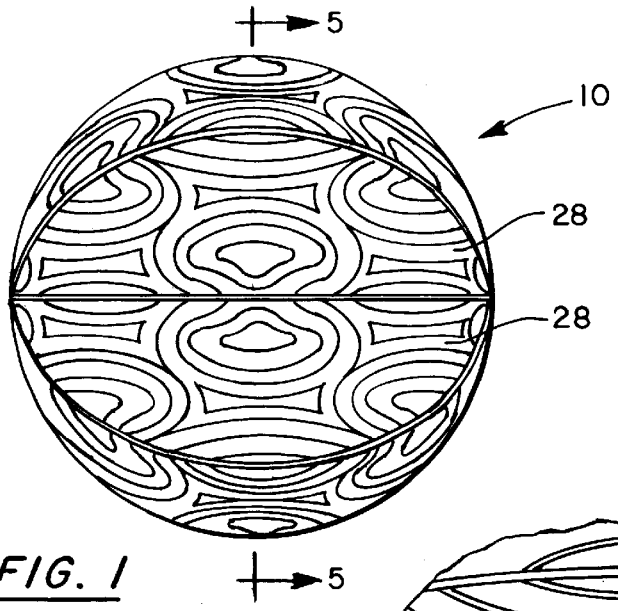
FIG. 1 is a perspective view of the preferred embodiment of the basketball constructed in accordance with the principles of the present invention.
Figure 2:
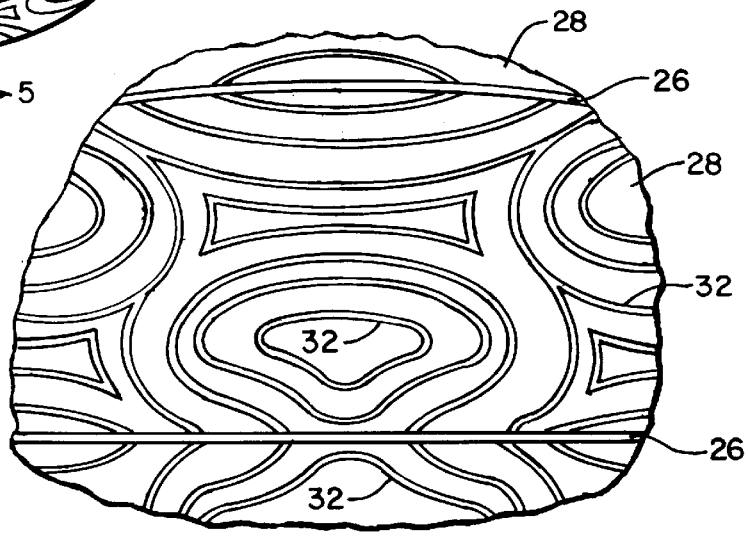
FIG. 2 is an enlarged view of the interconnecting concentric loops portion of the ball of FIG. 1.
Figure 3:
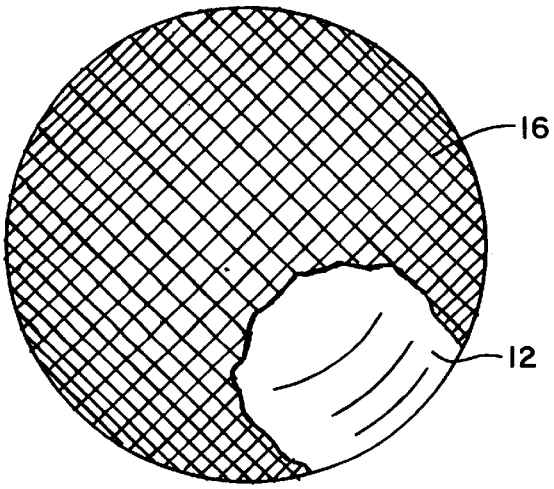
FIG. 3 is similar to FIG. 1 without the exterior covering to expose the interior structure.
Figure 4:
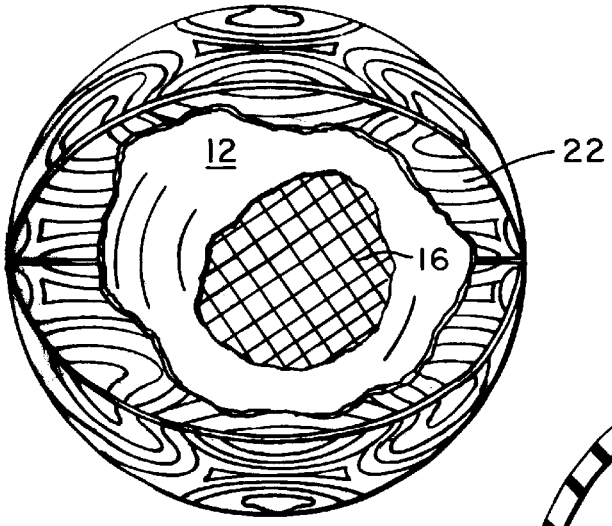
FIG. 4 is similar to FIGS. 1 and 3 with only a portion of the interior exposed.
Figure 5:
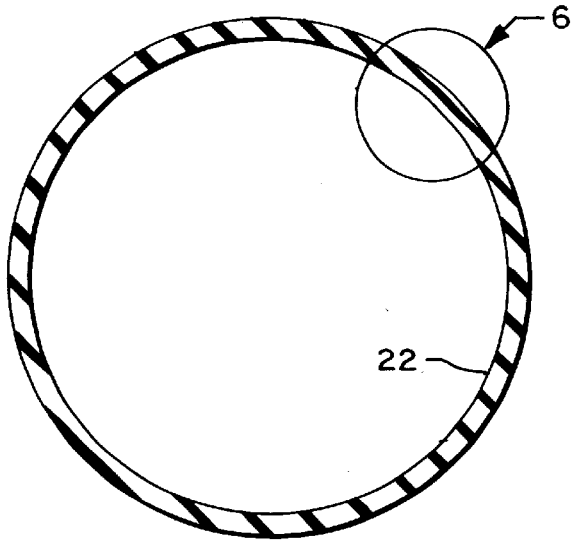
FIG. 5 is a cross sectional view taken along line 5—5 of FIG. 1.
Figure 6:
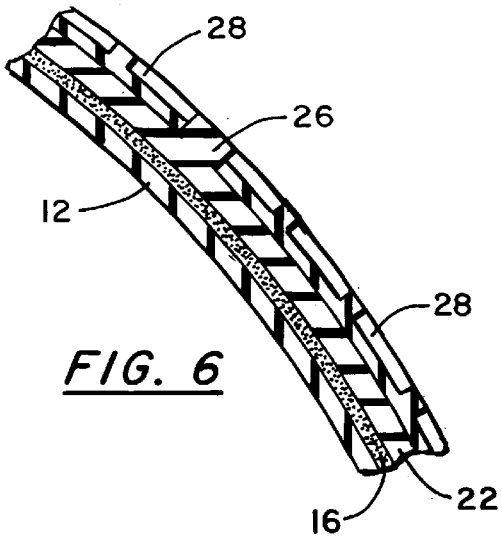
FIG. 6 is an enlarged view taken at the circle 6 of FIG. 5.

With reference now to the drawings, and in particular to FIG. 1 thereof, the preferred embodiment of the new and improved basketball embodying the principles and concepts of the present invention and generally designated by the reference numeral 10 will be described.

The present invention, the basketball 10 is comprised of a plurality of components. Such components in their broadest context include a bladder with spiral strands there around, a carcass, panels and a surface formed with projections including loops with supplemental projections there within. Such components are individually configured and correlated with respect to each other so as to attain the desired objectives. The central component of the basketball is a bladder 12. Such bladder is preferably fabricated of an air impervious elastomeric material in a spherical configuration. The preferred material is a butyl rubber compound. Such bladder is formed with spiral strands 16 there around. Such strands are of essentially inelastic material, preferably nylon or polyester multi-filament strands wrapped around the bladder in random configuration to maintain the size and shape of the ball when inflated and during use.

A carcass 22 is formed over the spiral strands. Such carcass is fabricated of a rubber compound molded over the wound bladder, Natural rubber is preferred for improved rebound and abrasion resistance. Such carcass has a plurality of ribs 26. Such ribs have a thickness of between about 0.2 and 2.0 millimeters, preferably about 1.0 millimeters extending outwardly from the carcass.

The basketball 10 also comprises a plurality of panels 28, preferably leather, coupled to the exterior surface of the carcass between the supplemental ribs. Such panels may be of a natural leather or of a synthetic leather. These panels have a thickness of between about 0.2 and 2.0 millimeters, preferably about 1.0 millimeters.

Finally, the basketball comprises projections, shown as loops 32 formed on the panels. The interconnecting concentric loops are shown as closed loops which include interior small loops surrounded by concentric intermediate loops and exterior unclosed loops which interconnect with exterior loops adjacent thereto but may be round or of any other shape. The loops extend outwardly from the panels to a distance radially equal to the distance that the ribs 26 extend outwardly from the carcass.

Figure 7:
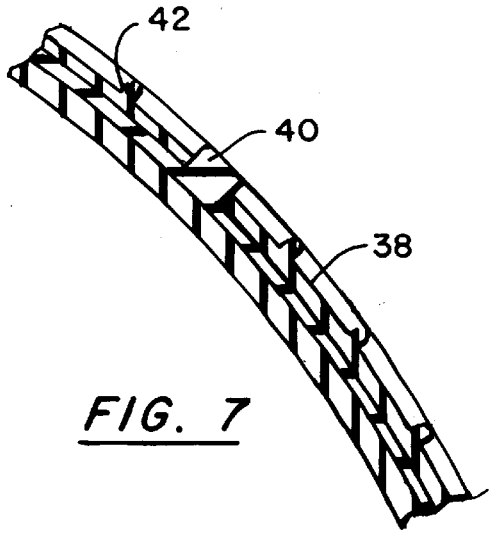
FIG. 7 is similar to FIG. 6, but illustrating an alternative embodiment of the invention.

An alternative embodiment of the invention is shown in FIG. 7. In such embodiment, the panels 38 are formed integrally with the carcass. Such panels are preferably formed with a surface to simulate the appearance and feel of natural leather. In such embodiment the carcass of the ball also includes integrally formed ribs 40 and pebbles 42 all extending radially outwardly to a common radial distance. This allows for a less costly fabrication as than would occur with the primary embodiment with the separate leather panels coupled to the bladder.

In an alternate embodiment of the invention a bladder is first provided. The bladder is fabricated of an air impervious elastomeric material. The bladder is formed in a spherical configuration with spiral strands there around. A carcass is next provided. The carcass is formed in a spherical configuration. The carcass overlies the strands. A series of ribs extend outwardly from the carcass. The ribs have a thickness of between about 0.2 and 2.0 millimeters, preferably about 1.0 millimeters. A plurality of panels are provided over the majority of the extent of the carcass. The panels are coupled to the exterior surface of the carcass between the ribs. The panels have a thickness of between about 0.2 and 2.0 millimeters, preferably about 1.0 millimeters. The panels have an exterior surface formed with a plurality of raised projections. Such descriptions are essentially the same as in the prior embodiments. The raised projections of the embodiment of FIG. 8 have a height of between about 0.030 inch and 0.120 inch, preferably about 0.100 inch. The projections are in the form of loops 50, 52, 54, 56 with supplemental projections there within. The projections have a surface area covering between about 20 percent and 70 percent of the surface area of the ball. The areas between the projections are between about 0.15 inch and 0.50 inch. The projections include primary loops 50 (in a T-shaped configuration), 52 (in a generally rectangular configuration), 54 (in a dog-bone shaped configuration), 56 (in a Y-shaped configuration) with supplemental, generally linear projections 60 (in a T-shaped configuration), 62 (in an I-shaped configuration), 64 (in a linear configuration), 66 (in a Y-shaped configuration) within the primary loops.

Figure 8:
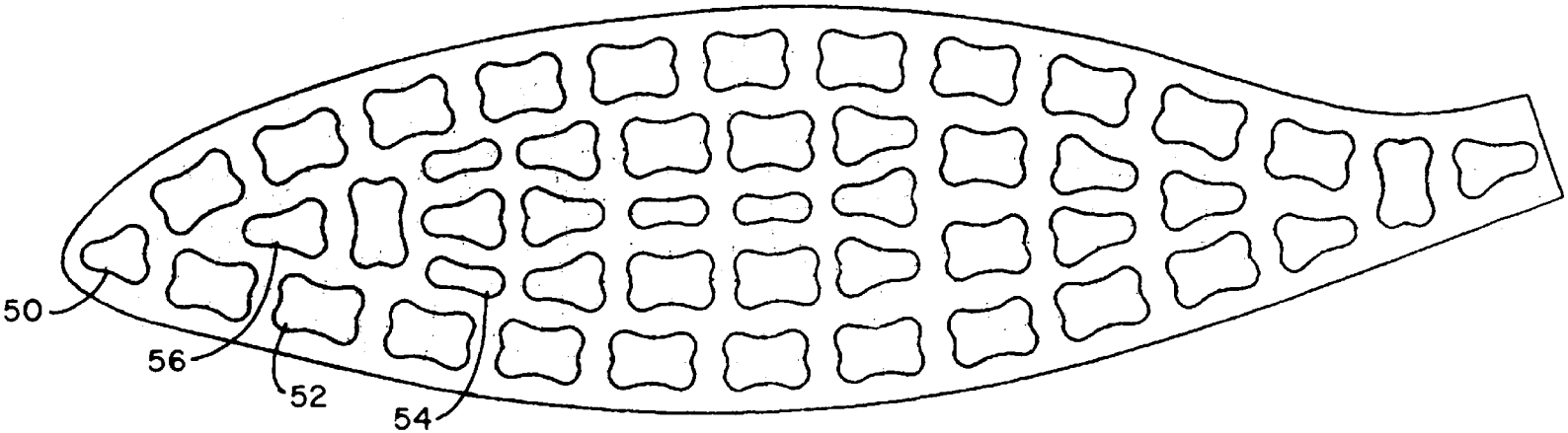
FIG. 8 is a plan view of a panel of a basketball constructed in accordance with yet another alternate embodiment of the invention.
Figure 8B:
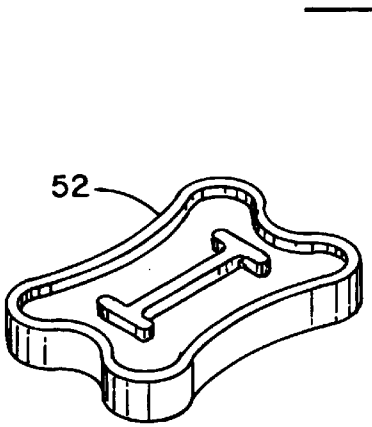
FIG. 8B is an enlarged perspective view of one of the projections shown in FIG. 8 such as at the periphery thereof.
Figure 8A:
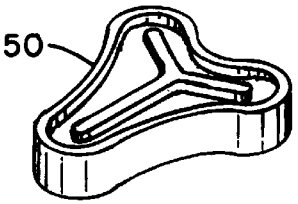
FIG. 8A is an enlarged perspective view of one of the projections shown in FIG. 8 such as at the end thereof.
Figure 8C:
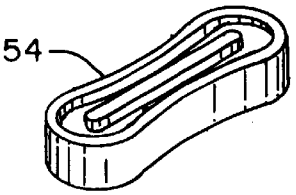
FIG. 8C is an enlarged perspective view of one of the projections shown in FIG. 8 such as at the center thereof.
Figure 8D:
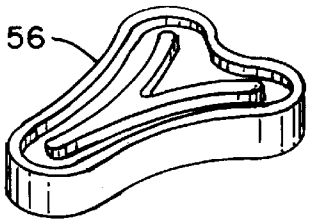
FIG. 8D is an enlarged perspective view of additional projections shown in FIG. 8.
Figure 9:
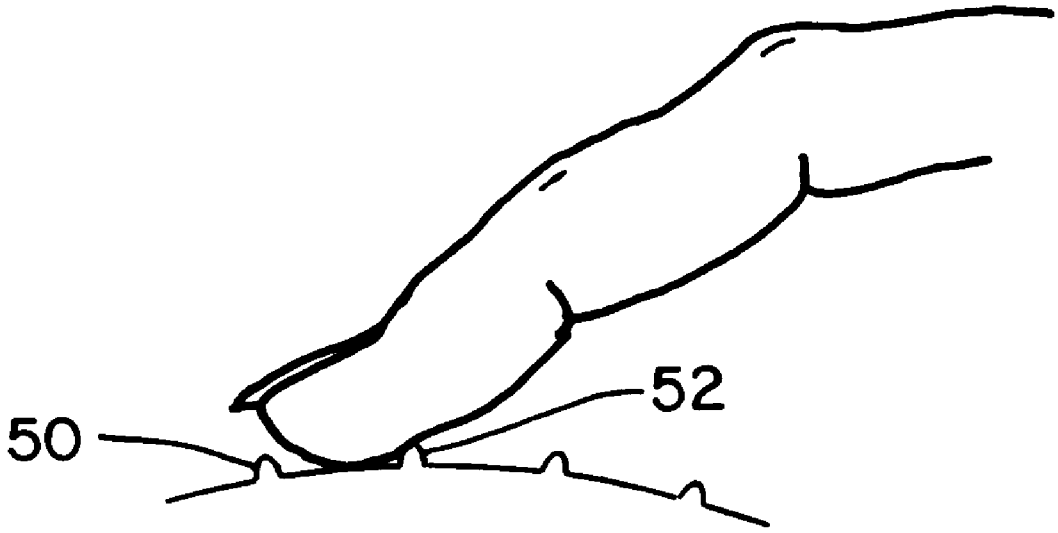
FIG. 9 is an enlarged showing of a finger resting on one of the projections of the embodiments described herein above.

The major advantage of the present invention is to allow the player to get a better grip on the ball. To accomplish a series of raised projections are added to the surface of the ball. There projections cover a majority of the surface of the ball. The projections are separated by a distance that allows the tips of a players fingers to fit between the projections. A tangential force can then be applied to the ball. Prior art balls do not allow tangential forces to be applied except for the normal eight seam areas found on the surface of basketballs which are widely spaced and cover a minimum of the surface area. A wide variety of specific designs of projections could be utilized. Consider the plurality of concentric loops of FIG. 1 as well as the series of waffle-like teeth formed of loops with supplemental projections there within as shown in FIG. 8.

The key to the present invention is to provide a series of projections that cover a majority of the ball and thereby allow a player to apply a very easy grip to the ball while applying a tangential force to the ball. In the preferred embodiment, the projections should have a surface area covering greater than 20 percent of the ball. The areas between the projections should range from between about 0.15 inches to about 0.50 inches. The projections should, in the preferred embodiment, cover between about 20 and 70 percent of the surface area of the ball. It should be understood further, that the design of the present invention is most suitable for a basketball. It should be understood that the present invention is also applicable to other game balls, such as a football or a soccer ball. It should also be understood that it is possible to add color to the ball on its surface by molding in two steps. In such case, the projections on the ball could be produced in a different color and/or a different hardness than that of the rest of the surface area of the ball. Additionally, it should be understood that the external surface of the ball could be fabricated of a wide variety of materials such as leather or rubber or a synthetic material.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved basketball having improved gripability comprising, in combination:

a bladder fabricated of an air impervious elastomeric material in a spherical configuration with spiral strands therearound;

a carcass in a spherical configuration overlying the strands, the carcass having a series of ribs with a thickness of between about 0.2 and 2.0 millimeters, extending outwardly from the carcass;

a plurality of panels coupled to the exterior surface of the carcass between the ribs, the panels having a thickness of between about 0.2 and 2.0 millimeters, preferably about 1.0 millimeters, over the majority of its extent and with an exterior surface formed with a plurality of raised projections, the raised projections having a height of between about 0.030 inch and 0.120 inch, the projections being in the form of loops with supplemental projections there within, the projections having a surface area covering between about 20 percent and 70 percent of the surface area of the ball and with the areas between the projections being between about 0.15 inch and 0.50 inch, the projections including primary loops with supplemental, generally linear projections within the primary loops.

2. A game ball with increased gripability comprising a bladder fabricated of an air impervious elastomeric material and a carcass overlying the bladder, the carcass having a common thickness over the majority of its extent and with an exterior surface of the ball formed with a plurality of raised projections, the raised projections having a height of between about 0.030 inch and 0.120 inch, the raised projections being in the form of primary loops with supplemental generally linear projections there within, the projections having a surface area covering greater than 20 percent of the ball.

3. The game ball as set forth in claim 2 wherein the primary loops are generally T-shaped and the supplemental linear projections are generally T-shaped.

4. The game ball as set forth in claim 2 wherein the primary loops are generally rectangularly shaped and the supplemental linear projections are generally I-shaped.

5. The game ball as set forth in claim 2 wherein the primary loops are generally dog-bone shaped and the supplemental linear projection is line-shaped.

6. The game ball as set forth in claim 2 wherein the primary loops are generally Y-shaped and the supplemental linear projections are generally Y-shaped.

7. The game ball as set forth in claim 2 wherein the projections have a surface area covering between about 30 percent and 70 percent of the surface area of the ball.

8. The game ball as set forth in claim 2 wherein the exterior surface of the ball is fabricated of leather.

9. The game ball as set forth in claim 2 wherein the exterior surface of the ball is fabricated of rubber.

10. The game ball as set forth in claim 2 wherein the exterior surface of the ball is fabricated of a synthetic material.

* * * * *